US008186869B2

(12) United States Patent
Gauer

(10) Patent No.: US 8,186,869 B2
(45) Date of Patent: May 29, 2012

(54) METHOD AND DEVICE FOR DOSING AND MIXING SMALL AMOUNTS OF LIQUID

(75) Inventor: Christoph Gauer, Munich (DE)

(73) Assignee: Beckman Coulter, Inc., Brea, CA (US)

( * ) Notice: Subject to any disclaimer, the term of this patent is extended or adjusted under 35 U.S.C. 154(b) by 1115 days.

(21) Appl. No.: 11/794,770

(22) PCT Filed: Dec. 16, 2005

(86) PCT No.: PCT/EP2005/013598

§ 371 (c)(1),
(2), (4) Date: Mar. 10, 2008

(87) PCT Pub. No.: WO2006/072384

PCT Pub. Date: Jul. 13, 2006

(65) Prior Publication Data

US 2008/0186799 A1 Aug. 7, 2008

(30) Foreign Application Priority Data

Jan. 5, 2005 (DE) ..... 10 2005 000 835

(51) Int. Cl.
*B01F 11/00* (2006.01)

(52) U.S. Cl. ..... 366/127; 366/137

(58) Field of Classification Search ..... 366/127, 366/154.2, 177.1, 341, DIG. 4, 136, 137
See application file for complete search history.

(56) References Cited

U.S. PATENT DOCUMENTS 2,685,499 A * 8/1954 Hood ..... 423/554
4,955,723 A * 9/1990 Schneider ..... 366/136
5,472,603 A 12/1995 Schembri
5,674,742 A 10/1997 Northrup et al.
6,010,316 A 1/2000 Haller et al.
6,086,243 A * 7/2000 Paul et al. ..... 366/273
6,210,128 B1 4/2001 Rife et al.
6,244,738 B1 * 6/2001 Yasuda et al. ..... 366/114
6,394,759 B1 5/2002 Parce
6,408,878 B2 6/2002 Unger et al.
6,568,052 B1 5/2003 Rife et al.

(Continued)

FOREIGN PATENT DOCUMENTS

DE 100 55 318 12/2001

(Continued)

OTHER PUBLICATIONS

Nature Biotechnology vol. 17, Nov. 1999, pp. 1109-1111.

(Continued)

*Primary Examiner* — David Sorkin
(74) *Attorney, Agent, or Firm* — Kilpatrick Townsend & Stockton LLP

(57) ABSTRACT

A method or device for integrated dosing and intermixing of small amounts of liquid, has a first liquid conveyed into or onto a first reservoir (3). A second reservoir (1) is entirely filled with a second liquid. The first and second liquids are brought into contact with each other via at least one joining duct structure (5) which has at least one area provided with a smaller cross section than the reservoirs (1,3) in the viewing direction of the connecting line between the two reservoirs (1,3). A laminar flow pattern is created along at least one portion of the joining duct structure (5), with the liquids thoroughly mixed in the second reservoir (1).

11 Claims, 7 Drawing Sheets

U.S. PATENT DOCUMENTS

| | | | | |
|---|---|---|---|---|
| 6,935,768 | B2 * | 8/2005 | Lowe et al. | 366/167.1 |
| 7,347,617 | B2 * | 3/2008 | Pugia et al. | 366/341 |
| 7,381,241 | B2 * | 6/2008 | Tessien et al. | 95/30 |
| 7,459,304 | B2 * | 12/2008 | Gauer | 435/287.2 |
| 2001/0055529 | A1 | 12/2001 | Wixforth | |
| 2002/0036018 | A1 | 3/2002 | McNeely et al. | |
| 2002/0137196 | A1 | 9/2002 | Miles et al. | |
| 2003/0000835 | A1 | 1/2003 | Witt et al. | |
| 2004/0072366 | A1 | 4/2004 | Wixforth et al. | |
| 2004/0101975 | A1 * | 5/2004 | Gauer | 436/518 |
| 2004/0109793 | A1 | 6/2004 | McNeely et al. | |
| 2004/0257906 | A1 * | 12/2004 | Scriba et al. | 366/127 |
| 2005/0037507 | A1 * | 2/2005 | Gauer | 436/163 |
| 2005/0092681 | A1 * | 5/2005 | Higashino et al. | 210/634 |
| 2006/0275883 | A1 | 12/2006 | Rathgeber et al. | |
| 2010/0027372 | A1 * | 2/2010 | Ozawa et al. | 366/341 |
| 2011/0045595 | A1 * | 2/2011 | Gauer | 436/8 |

FOREIGN PATENT DOCUMENTS

| | | | |
|---|---|---|---|
| DE | 101 36 008 | | 2/2003 |
| DE | 101 42 789 | | 5/2003 |
| DE | 103 25 307 | | 7/2004 |
| DE | 103 25 313 | | 7/2004 |
| EP | 1418003 | | 5/2004 |
| JP | 2003-535349 | T | 11/2003 |
| JP | 2004-163104 | A | 6/2004 |
| JP | 2004-517335 | T | 6/2004 |
| WO | 03/012389 | | 2/2003 |
| WO | 03/018181 | | 3/2003 |

OTHER PUBLICATIONS

Science vol. 282, Oct. 16, 1998, pp. 484-486.
Applied Physics Letters, vol. 77, No. 11, Sep. 11, 2000, pp. 1725-1726.
Acoustic Streaming, pp. 265-271.

* cited by examiner

METHOD AND DEVICE FOR DOSING AND MIXING SMALL AMOUNTS OF LIQUID

This application is a U.S. National Phase Application under 35 U.S.C. §371 of International Application No. PCT/EP2005/013598, filed on Dec. 16, 2005, which claims the benefit of priority from German Patent Application DE10200500835.6, filed Jan. 5, 2005, the entire contents of all of which are incorporated herein by reference.

The invention relates to a method for the integrated metering and mixing of small quantities of liquid, to a device and to an apparatus for carrying out this method and to a use.

Diagnostic assays, in particular in the field of clinical chemistry and immunochemistry, are carried out in an automated manner to a large extent today. Defined volumes of sample liquid and reagents are pipetted into a cuvette or into the well of a microtiter plate and mixed in the corresponding automatic units. Subsequently, a first reference measurement is made in which, for example, the optical transmission through the cuvette is determined. After a certain reaction time between the sample and the reagents, a second measurement of the same parameter is made. The concentration of the sample with respect to a specific constituent or also only the presence of the constituent results by the comparison of the measured values. Typical volumes lie in sum at some hundred microliters, with necessary mixture ratios of sample to reagent being able to occur between 1:100 and 100:1. Optionally, a plurality of reagents can also be provided for mixing with a sample. In addition to the instruments just described for a high throughput, which are typically to be found in special laboratories, there are also endeavors to carry out assays in a decentral manner and without any large instrumental effort. It would be desirable in this connection if the "lab-on-a-chip" technology recently introduced could be used in which the processing of liquids on or in a chip be can carried out in an integrated manner. Assay times of less than one hour are desirable.

Microfluid systems are used, for example, for the movement of the liquids in which liquid is moved through electroosmotic potentials, see for example Anne Y. Fu, et al. "A micro fabricated fluorescence-activated cell sorter", Nature Biotechnology Vol. 17, November 1999, p. 1109 ff.

A method for liquid mixing in the microliter range is described in DE 103 25 307 B3 in which small liquid volumes are mixed in microtiter plates with the help of noise-induced flow. Another method for the generation of movement in small quantities of liquid on a solid surface is described in DE 101 42 789 C1. Here, a liquid is mixed or a plurality of liquids are mixed with one another with the help of surface sound waves.

In accordance with a method described in DE 100 55 318 A1, a quantity of liquid is placed onto a region of a substantially planar surface whose wetting properties differ from the surrounding surface such that the liquid preferably remains there, with it being held together by its surface tension. Movement of the quantity of liquid can be generated in this connection by the pulse transfer of a surface sound wave to the liquid.

In particular the integration of the metering and the mixing of the sample and the reagents in a cost-favorable lab-on-a-chip system is problematic. A homogeneous mixing of different quantities of liquid which are so small is difficult to realize.

It is necessary to define volumes of quantities of liquid precisely for the metering. This can be carried out geometrically, for example. For example, in an open system, the wetting properties of the surface can thus determine a volume, as is described in DE 100 55 318 A1. Here, the definition of the volumes takes place by hydrophilic and hydrophobic regions over the wetting angle on a substantially smooth surface. If a plurality of volumes were defined in this manner which should be brought to reaction, the volumes are moved toward one another to achieve this. On the movement on a surface, liquid residues or molecules of the analyte or of the reagent located in the liquid can remain stuck to the surface so that a volume loss or a reduction in concentration of unknown amount cannot be precluded by the movement. In addition, measures must be taken against evaporation which can in particular be problematic with longer assay times.

Other preparations use passages of defined cross-section which are filled with liquid in a capillary manner. If the liquid is an aqueous solution, a hydrophobic barrier which cannot be filled in a capillary manner is attached to the end of the passage. Furthermore, there is a lateral branch at this passage with a likewise hydrophobic surface which cannot be filled in a capillary manner. The cross-section and length of the passage between the hydrophobic barrier and the hydrophobic branch now determine a volume which can be separated and moved in a defined manner by pneumatic pressure through the branch (Burns et al., An integrated nanoliter DNA analysis device, Science 282, 484 (1998)). High costs arise by this type of volume definition due to the necessary wetting structuring of the surface (hydrophilic for the filling of the passage itself and hydrophobic for the barrier and the branch). In addition, it is necessary to work with air pressure, which requires corresponding devices. The passage cross-section must be small to permit the capillary filling of the measurement passage. Long passages are therefore necessary with large volumes in the range of some 100 microliters. This necessarily results in large unwanted interactions of the molecules in the liquid with the passage wall. An efficient mixing of a plurality of quantities of liquid is almost impossible in this geometry.

The term "liquid" in the present text includes inter alia pure liquids, mixtures, dispersions and suspensions as well as liquids in which solid particles are located, for example biological material. Liquids to be metered and to be mixed can also, for example, be two or more similar solutions which differ by constituents dissolved therein which should be brought to reaction.

SUMMARY OF THE INVENTION

It is the object of the present invention to set forth a method and a device with whose help a precise metering of quantities of liquid on or in an integrated chip is possible and which permit a precise mixing of the liquids.

This object is satisfied by a method, a device or an apparatus having the features herein. Preferred embodiments and advantageous use are also described herein.

In a method in accordance with the invention for the integrated metering and mixing of small liquid volumes, a first liquid is brought into or onto a first reservoir. A second liquid is brought into or onto a second reservoir such that it is completely filled. The first and the second liquids are brought into contact via at least one first connection passage structure which includes at least one region which has a smaller cross-section than the reservoirs themselves in the direction of view of the connection line of the two reservoirs. An exchange of liquid is effected by laminar flow in the connection passage structure and the liquids mixed in or on the second reservoir.

In the method in accordance with the invention, the liquids come into contact via the connection passage structure. Only diffusion which can be neglected arises at the interface between the two liquids since the cross-section of the connection passage structure is comparatively small. If a laminar flow is generated along the connection passage structure in the direction of the second reservoir, the first liquid is moved through the connection passage structure in the direction of the second reservoir. A precise definition of the volume of the first liquid which should be metered to the second liquid takes place, for example, by a precise selection of the time over which the laminar flow is generated in the connection passage structure or of the flow speed. The quantity of the second liquid is precisely determined by the size of the reservoir. The reaction between the liquids then optionally takes place in or on the second reservoir. The second reservoir represents a reaction chamber in this respect. The method in accordance with the invention permits the metering and the mixing of liquids in large dynamic range. The mixing ratio of reagents to sample liquid can be set e.g. from 1:100 to 100:1.

Pipettes and/or corresponding filling structures can be employed for the filling of the reservoir at the start of the method in accordance with the invention. The demands on the precision of these elements are low since the definition of the volumes of liquid participating in the reaction are determined by the method in accordance with the invention or by the device in accordance with the invention themselves, in particular by the duration or the speed of the laminar flow in the connection passage structure and the volume of the second reservoir.

The laminar flow is preferably caused by the radiation of sound waves in the direction of at least a part of the connection passage structure.

The reservoirs and the connection passage structure can be configured three-dimensionally or two-dimensionally. The reservoirs and connection passage structures can thus be correspondingly shaped wells in a surface. In different configurations, they are correspondingly shaped hollow spaces. In a two-dimensional configuration, the reservoirs and connection passage structures are formed by correspondingly shaped regions of a surface which are more preferably wetted by the liquids than the surrounding regions of the surface. Such wet-modulated surfaces are described, for example, in DE 100 55 318 A1. The liquids are held on the preferably wet regions by their surface tension.

For simpler illustration, if it is not otherwise explicitly set forth, three-dimensional and two-dimensional realizations are each covered in the present text, even if terms are selected which only seem to describe one option. For example, the term "introduction into a reservoir" or "filling" is thus also used for the application of a liquid to a two-dimensional reservoir area. In a similar manner, the term "movement through the connection structure" is e.g. also used, etc., for the movement of liquid on a two-dimensional connection structure. The "volume" or the size of a "cross-section" in an analog manner mean the surface or the width in two-dimensional realizations.

The quantity of the second liquid participating in the reaction is determined by the dimensions of the second reservoir. If the second reservoir, for example, is filled by corresponding filling structures, e.g. filling passages and/or filling stubs, any existing overspills of liquid in these filling structures outside the reservoir do not participate in the mixing for geometrical reasons, in particular when the mixing is effected by laminar flow patterns.

In an advantageous aspect of the method in accordance with the invention, the laminar flow in or on the connection passage structure is generated with the help of sound waves. Surface sound waves are preferably used which can be generated, for example, using or more interdigital transducers. Surface sound waves transmit their pulse onto the liquid or onto substances contained therein to thus set them into motion. The pulse transfer of surface sound waves generated with the help of interdigital transducers to liquids in surfaces is generally described in DE 100 55 318 A1.

In a further development in accordance with the invention using an interdigital transducer, the latter has a radiation direction in the direction of the extent of at least a part of the connection passage structure.

The first and the second liquids can be brought into contact via the connection passage structure, for example while making use of capillary forces. For this purpose, the connection passage structure is selected to be so small in its lateral dimensions that at least one of the liquids is drawn along the passage by the capillary forces. In accordance with a preferred process management, a first liquid can thus e.g. be brought onto or into the first reservoir and spreads in or on the connection passage structure through the capillary forces. The liquid stops its movement at the inlet position of the connection passage structure into the second reservoir since only small capillary forces still act due to the larger cross-section of the reservoir in comparison with the connection passage structure. The second liquid, which comes into contact with the first liquid at the inlet position of the connection passage structure into the second reservoir, is applied into or onto the second reservoir.

In a different process management, the connection between the two liquids is established via a small "bridging drop" which is brought between the two liquids and generates a liquid bridge. The bridging drop has a very much smaller volume than each of the two quantities of liquid.

Pipettes and/or corresponding filling structures can be employed for the filling of the reservoir at the start of the method in accordance with the invention. The demands on the precision of these elements are low since the definition of the volumes of liquid participating in the reaction are determined by the method in accordance with the invention or by the device in accordance with the invention themselves, in particular by the duration or the speed of the laminar flow in the connection passage structure and the volume of the second reservoir.

The filling structures can likewise include filling passage structures with cross-sections small in comparison with the reservoirs. The manufacture of a corresponding structure is very simple since the same process steps are used which are also used in the manufacture of the reservoirs or in the connection passage structure.

The comparatively small cross-sections effectively prevent liquid overspills possibly present in the filling passage structures after the filling from participating in the mixing. It is prevented in this manner that liquid overspills possibly still present in the filling passage structures make the determination of the liquid volumes participating in the mixing imprecise.

It is moreover additionally ensured by low cross-sections of the filling structures that an uncontrolled diffusion due to liquid boundaries possibly present in the filling structures is negligible due to the small cross-section.

Filling passage structures of this type can have a small cross-section which ensures that the liquid moves through the filling passage structures or on the filling passage structures due to capillary action in the direction of the reservoirs. A precise filling can thus be carried out simply.

The method in accordance with the invention can be carried out with a single connection passage structure between the two reservoirs. The first reservoir is at least partly emptied by the laminar outflow of the first liquid. Another aspect in accordance with the invention includes at least two connection passage structures between the two reservoirs. A laminar flow which serves for the movement of the first liquid from the first reservoir in the direction of the second reservoir is generated in one of these connection passages, for example with the help of surface sound waves. The first liquid in the first reservoir therefore becomes less and less due to the laminar outflow. Second liquid simultaneously flows back into the first reservoir from the second reservoir via the second connection passage structure.

After the metering of the desired quantity of the first liquid into the second liquid in the second reservoir, the liquids are mixed. It is particularly favorable for this mixing process to be effected by generation of substantially laminar flow patterns. It is thus ensured that any overspills at the filling structures participate as little as possible, or not at all, in the mixing.

In particular sound waves which are radiated into the second reservoir are suitable for the generation of such flow patterns. They can e.g. be generated with the help of surface sound waves. They can be used directly to generate flow in the liquid by their pulse transfer. In other realizations, the surface sound waves can be used to radiate sound waves into the liquid through a solid body, for example through a reservoir base. Interdigital transducers which are known per se and which can be manufactured simply using lithographic techniques can be used for the generation of surface sound waves.

It is preferred for separate devices to be used for the generation of the laminar flow and for the mixing. However, the invention also includes embodiments in which the laminar flow and the mixing are generated using the same device.

The method in accordance with the invention is not limited to the metering and mixing of only two quantities of liquid. For example, further reservoirs from which further liquids can be metered into the second reservoir can thus additionally be connected to the second reservoir via further connection passage structures. The metering in can take place simultaneously or successively.

A device in accordance with the invention for the metering of small quantities of liquid has a first reservoir for a first liquid, a second reservoir for a quantity of a second liquid and at least one connection passage structure which connects the two reservoirs and has a cross-section in at least one region which is smaller than the cross-sections of the reservoir in the direction of view of the connection line of the reservoirs. The reservoirs and the at least one connection passage structure can be configured as wells or as hollow spaces in a solid body. In a two-dimensional aspect of the device in accordance with the invention, the reservoirs and the at least one connection passage structure are formed by surface regions which are more preferably wetted by the liquids.

The device in accordance with the invention furthermore has at least one device for the generation of laminar flow along the at least one connection passage structure. A preferred embodiment includes for this purpose a device for the generation of sound waves, preferably surface sound waves. The use of at least one interdigital transducer for the generation of surface sound waves is particularly simple which can be manufactured simply using lithographic techniques.

In addition, the device in accordance with the invention has at least one device for the mixing of the quantities of liquid in or on the second reservoir. In a preferred embodiment, a second sound wave generation device is provided for this purpose for the generation of sound waves entering into the second reservoir.

The device in accordance with the invention can be configured as a cost-effective and practical disposable part.

A device in accordance with the invention which should be used for the metering and mixing of more than two quantities of liquid has a corresponding number of reservoirs with a corresponding number of connection passage structures for the integrated metering and mixing of more than two quantities of liquid.

Advantages of the device in accordance with the invention and preferred embodiments of the dependent claims result from the above description of the advantages and preferred aspects of the method in accordance with the invention.

The method in accordance with the invention and the device in accordance with the invention can be used particularly effectively for the metering and mixing of biological liquids in which a precise metering of very small quantities of liquid is necessary.

The devices in accordance with the invention can be operated automatically with a correspondingly configured automatic machine.

BRIEF DESCRIPTION OF THE DRAWINGS

Embodiments and aspects of the invention will be explained in detail with reference to the enclosed Figures. The Figures are not necessarily to scale and serve for schematic presentation. There are shown.

DESCRIPTION OF THE PREFERRED EMBODIMENTS

Figure 1:
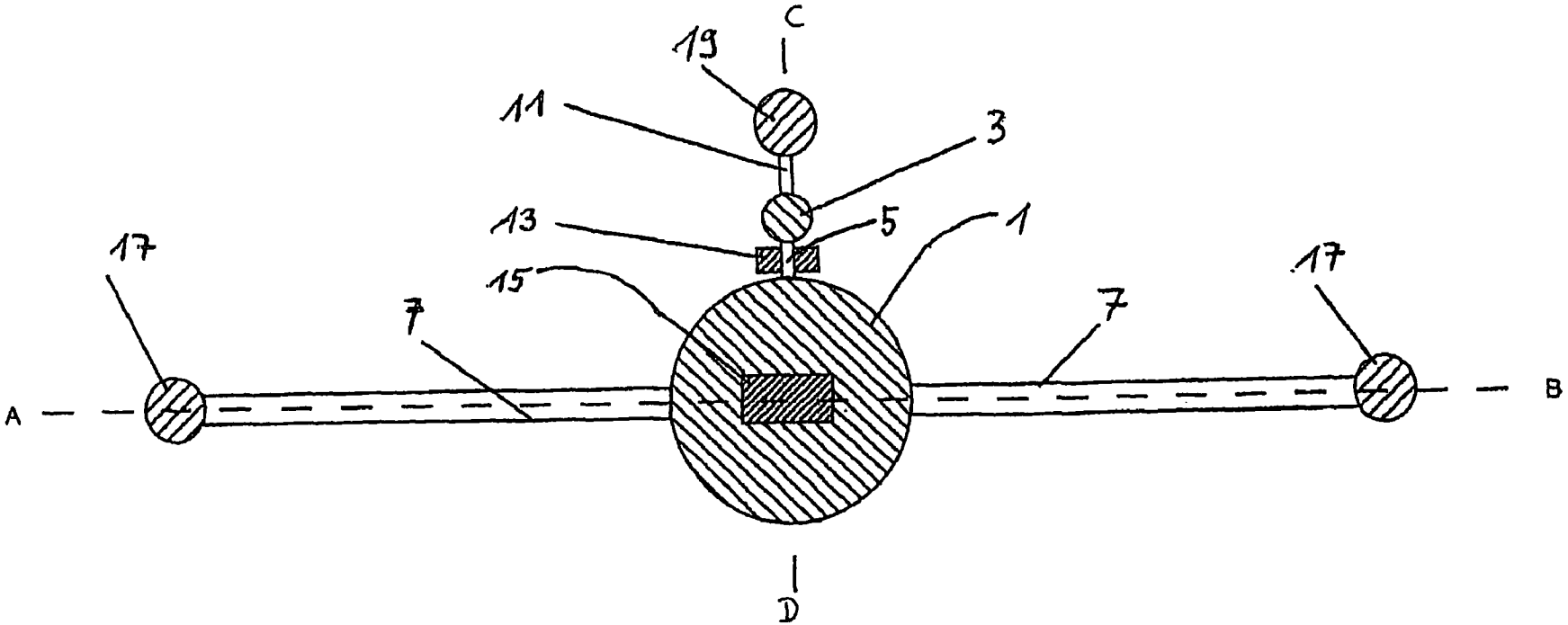
FIG. 1 a horizontal cross-section through a device in accordance with the invention.
Figure 2:
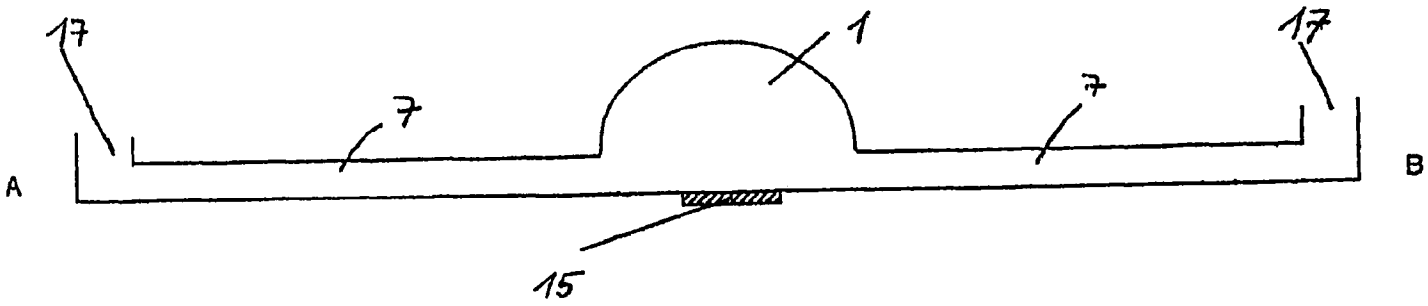
FIG. 2 a section through a device of FIG. 1 in accordance with the invention along the line A-B.
Figure 3:
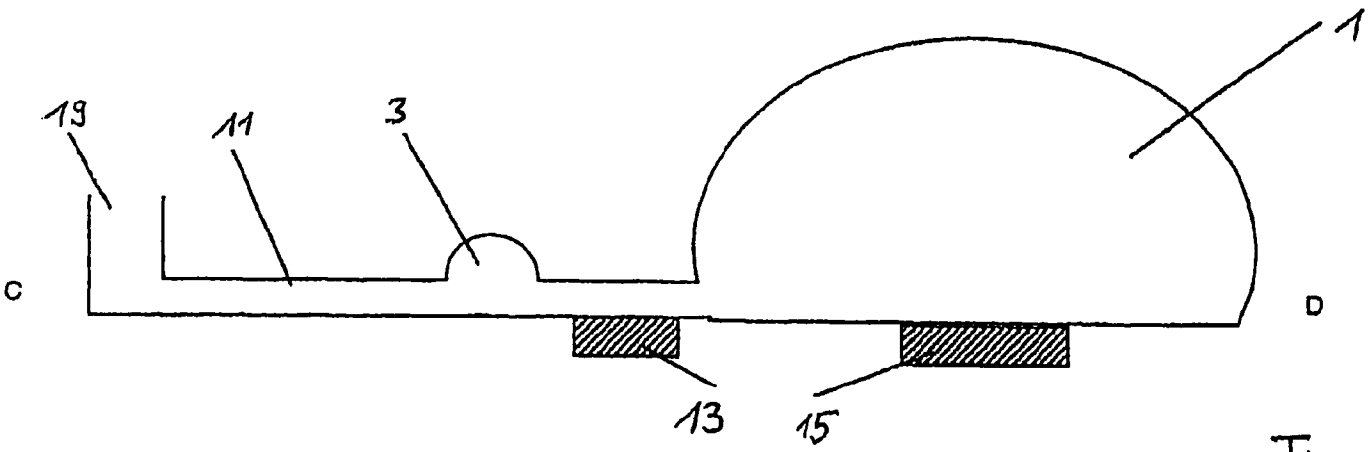
FIG. 3 a section through a device of FIG. 1 in accordance with the invention along the line C-D.

The embodiment shown schematically in FIGS. 1 to 4 comprises a disposable part manufactured from plastic, for example. Whereas FIG. 1 shows the horizontal cross-section to illustrate the arrangement of the individual elements, FIG. 2 shows a section along the line A-B and FIG. 3 shows a section along the line C-D.

Figure 4:
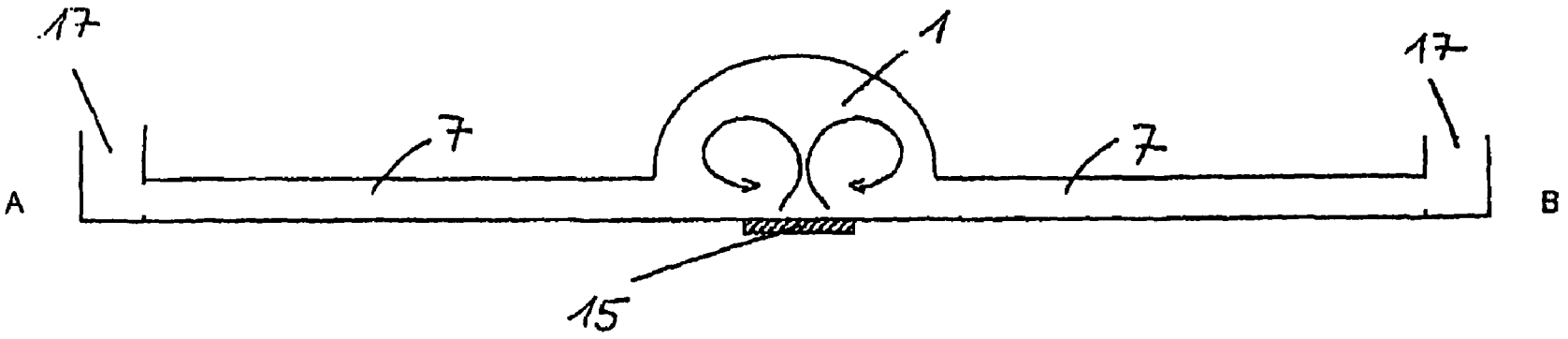
FIG. 4 the section of FIG. 2 on carrying out a step of the method in accordance with the invention.

The individual elements are, as can be clearly recognized in FIGS. 2 to 4, hollow spaces in the plastic part. Only the hollow spaces are shown in the side section Figures. The structures can be formed, for example, by pressing in metallic mating pieces of the molds and can subsequently be closed by a foil—from below here. Alternatively, the plastic part can be produced as an injection molded part.

The reservoir 1, for example, contains a volume of 100 or 150 μl, whereas the reservoir 3 has a volume of 5 μl. Reservoirs 1 and 3 are connected to one another via a capillary passage 5.

The reservoir 1 is connected via two further passages 7 to upwardly open filling stubs 17. The passages 7 likewise have such a small cross-section that capillary forces act on a liquid therein. The reservoir 3 is connected to the filling stub 19 via a capillary passage 11.

The dimensions and the process management are selected such that the Reynolds number of the liquids in consideration lies in the region of the laminar flow. The parameters required for this can be fixed in pre-trials. Typical viscosities of liquids used lie in the range from 1 mPa up to some 100 mPa at speeds of 1 mm per second up to 1 cm per second. Suitable system cross-sections are then in the range from some 100 μm with a total length of some cm.

13 designates an acoustic chip. It is, for example, a piezoelectric solid body chip on which an interdigital transducer is applied in a manner known per se for the generation of surface sound waves.

In the embodiment shown, the interdigital transducer on the acoustic chip 13 is a unidirectionally radiating transducer which only generates surface sound waves in the direction of the reservoir 1.

15 designates a further acoustic chip which likewise carries an interdigital transducer in a manner known per se. This interdigital transducer is configured such that the surface sound waves generated with it permit a sound wave radiation into the reservoir 1. The radiation of sound waves into a liquid volume which is remote from the interdigital transducer generating surface sound waves by a solid body is described in DE 103 25 307 B3. The acoustic chip 15 can also e.g. be provided on the other side of the reservoir 1.

The acoustic chips 13, 15 are connected via electrical connections which are not shown to an alternating voltage source with which an alternating voltage of a frequency of some 10 MHz can be generated to generate surface sound waves using the interdigital transducers.

A device of this type is used as follows for the carrying out of the method in accordance with the invention. The reservoir 3 is filled with a small quantity of liquid via the filling stub 19 and the capillary passage 11. This liquid enters into the passage 5 due to capillary forces. However, the liquid does not enter into the reservoir 1 since the cross-section is substantially larger there and so the capillary force becomes weaker abruptly.

The reservoir 1 is filled completely with the help of pressure, e.g. by a pipette having a larger quantity of another liquid. It is innocuous if overspills of liquid remain in the filling passages 7 for the reservoir 1 or the filler stub 17. They do not participate in the mixing process to be carried out later by generation of laminar flow patterns in the reservoir 1 for geometrical reasons and are therefore not relevant to the fixing of the liquid volume participating in the mixing process.

A contact automatically arises between the first liquid standing in the passage 5 and the second liquid filling the reservoir 1. Only diffusion between the two liquids to be neglected occurs at this fluid connection due to the small cross-section of the passage 5.

A laminar flow is generated due to the pulse transfer of the surface sound waves to the liquid in the passage 5 with the help of the unidirectional transducer on the chip 13 whose radiation direction goes in the direction of the reservoir 1. By selection of the time period over which the interdigital transducer is operated or by the pump power, the quantity of liquid which flows in a laminar manner via the capillary passage 5 into the reservoir 1 can be precisely fixed. The fixing of the required time period or of the pump power can be determined, for example, with reference to advance trials. The laminar flow therefore provides for a defined liquid supply.

The liquid which penetrates into the reservoir 1 from the passage 5 in this manner is replaced by liquid which is drawn from the reservoir 3.

The application of an electrical alternating field to the interdigital transducer of the acoustic chip 15 beneath the reservoir 1 results in a mixing of the liquids with the help of a laminar flow pattern, as is indicated in FIG. 4. The radiation of sound waves generated in this manner into the liquid on the reservoir 1 provides a substantially laminar flow pattern which results in the mixing of the liquids. The substantially laminar flow pattern guarantees that any present overspills of liquid in the filling structures do not participate in the mixing for geometrical reasons.

The reservoir 1 then serves as a reaction chamber in which a reaction of the two defined quantities of liquid or of their constituents can take place.

Figure 5:
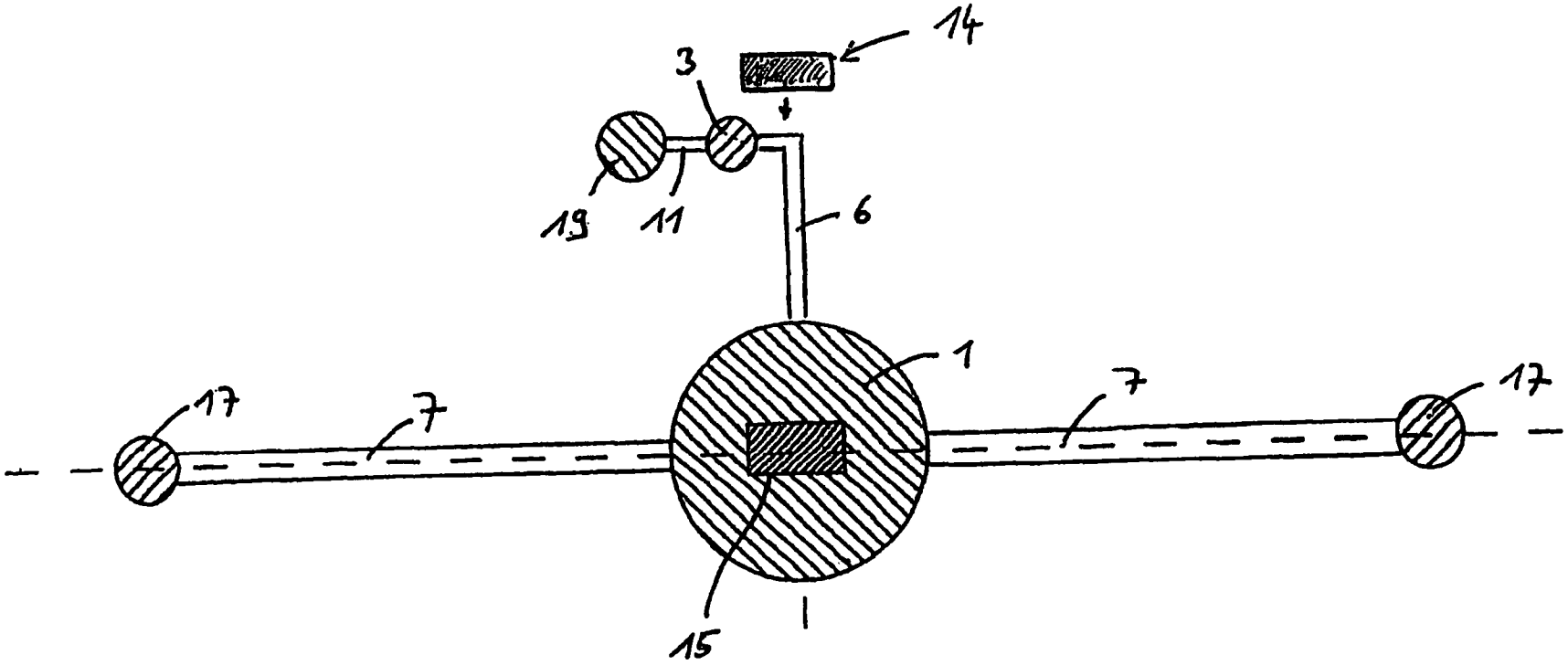
FIG. 5 a modification of the device of FIG. 1 in accordance with the invention in horizontal cross-section.

FIG. 5 shows a modification of the embodiment of FIGS. 1 to 4. Here, the capillary passage 6 between the reservoir 3 and the reservoir 1 is not in a straight line. An acoustic chip 14 with an interdigital transducer is used which does not have to radiate unidirectionally here. It is sufficient for the acoustic chip 14 to be arranged such that one of its radiation directions faces in the direction of the capillary s 6. A surface sound wave is radiated in the indicated direction by the operation of the acoustic chip 14 and the pulse transfer of said surface sound wave onto the liquid in the capillary passage 6 results in a laminar flow.

Figure 6:
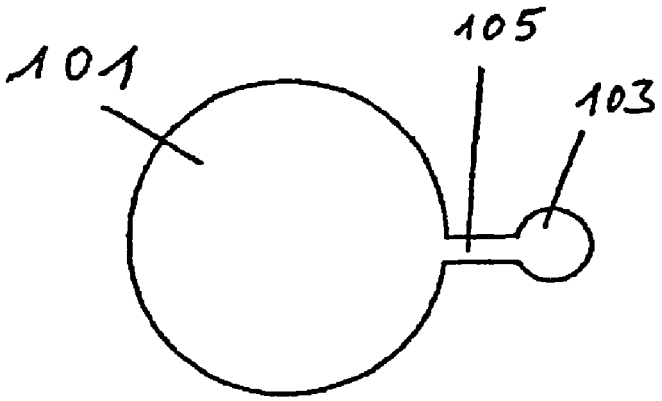
FIG. 6 the portion of a surface of a further embodiment of the device in accordance with the invention with a wet-modulated surface.
Figure 7:
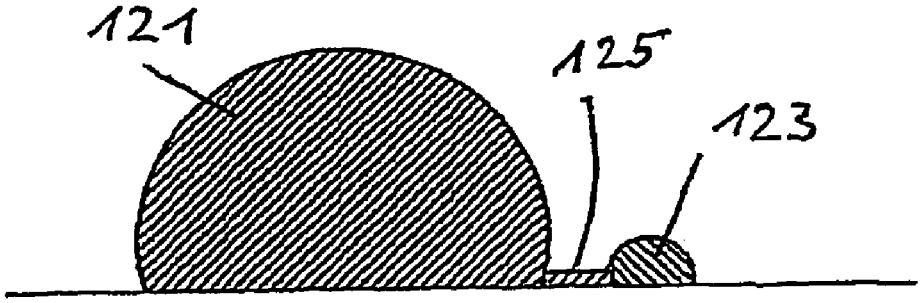
FIG. 7 a part side view of the embodiment of FIG. 6 during the carrying out of the method in accordance with the invention.

FIGS. 6 and 7 show an embodiment which can be realized on the surface of a solid body chip. Here, the reservoirs 101 and 103 include surface regions whose wetting properties are selected such that they are preferably wetted by a liquid. In the case of aqueous liquids, the reservoirs 101, 103 are hydrophilic in comparison with the surrounding solid body surface. This is e.g. achieved by silanization of the surrounding surface which results in a hydrophobic surface.

In the embodiment of FIGS. 6 and 7, the reservoirs 101 and 103 are connected by an areal connection passage structure 105 whose wetting properties are selected the same. An interdigital transducer is located in a manner not shown on the surface and its radiation direction goes along the passage 105 to generate laminar flow in the passage 105. The passage 105 is selected to be so narrow that capillary forces act on liquids located thereon.

Such a device is used as follows. A liquid drop 123 of a first liquid is applied to the reservoir 103 and does not move away outwardly from the reservoir 103 due to the described wetting properties of the surface and is held together by its surface tension. This liquid moves along the passage structure 105 due to capillary forces. The capillary forces at the connection position between the passage structure 105 and the larger reservoir surface 101, which become abruptly lower, stop the movement of the liquid at the connection position between the passage structure 105 and the reservoir 101. A second liquid drop 121 is applied to the reservoir surface 101. This liquid drop 121 is also held together by the selected wetting properties of the surface and its surface tension. Its size is selected such that the reservoir surface 101 is completely filled. The volume is thus determined by the selection of the size of the surface 101. Due to the small cross-section of the passage structure 105 only diffusion of the two liquids between one another which can be neglected occurs at the connection position between the passage structure 105 and the reservoir surface 101. A laminar flow is generated along the passage structure 105 by operation of the interdigital transducer which is not shown and whose radiation direction goes along the passage structure 105 and said laminar flow leads along the passage structure 105 for the liquid transport just as with the three-dimensional embodiments of FIGS. 1 to 5.

An interdigital transducer with whose help a laminar flow pattern is generated to mix the liquids is located in the region of the reservoir surface 101. The interdigital transducer is likewise not shown in FIGS. 6 and 7 for reasons of clarity.

The operation of the two-dimensional structure of FIGS. 6 and 7 in this respect corresponds to the operation of the three-dimensional structures of FIGS. 1 to 5.

In the lateral view of FIG. 7, the liquid drop 121 on the reservoir surface 101, the liquid drop 123 on the reservoir surface 103 and the liquid bridge 125 along the passage structure 105 can be recognized.

Figure 8:
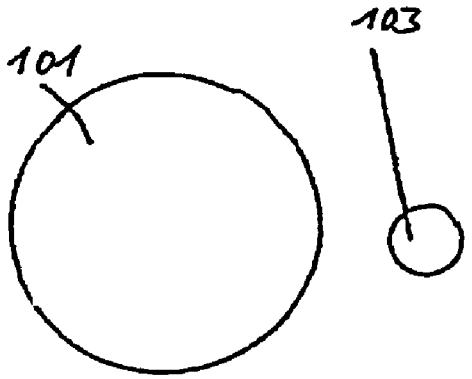
FIG. 8 a part view of a surface of a modification of the embodiment of FIG. 6.
Figure 9:
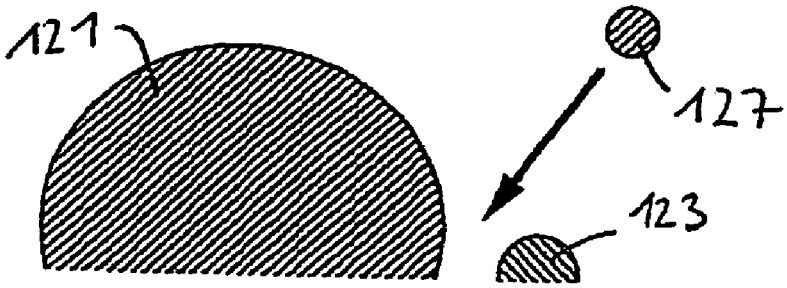
FIG. 9 a part side view of this embodiment during the carrying out of a step of the method in accordance with the invention.

FIGS. 8 and 9 show a modification of the embodiment of FIGS. 6 and 7. The reservoir surfaces 101 and 103 are here not connected to one another by a passage structure 105. A connection of the quantities of liquid 121 and 123 takes place here by direct introduction of a "bridging drop" 127 of small volume which provides a liquid bridge between the two quantities of liquid via which a liquid transport can take place in the described manner with the help of the laminar flow generated as with the embodiment of FIGS. 6 and 7.

Figure 10:
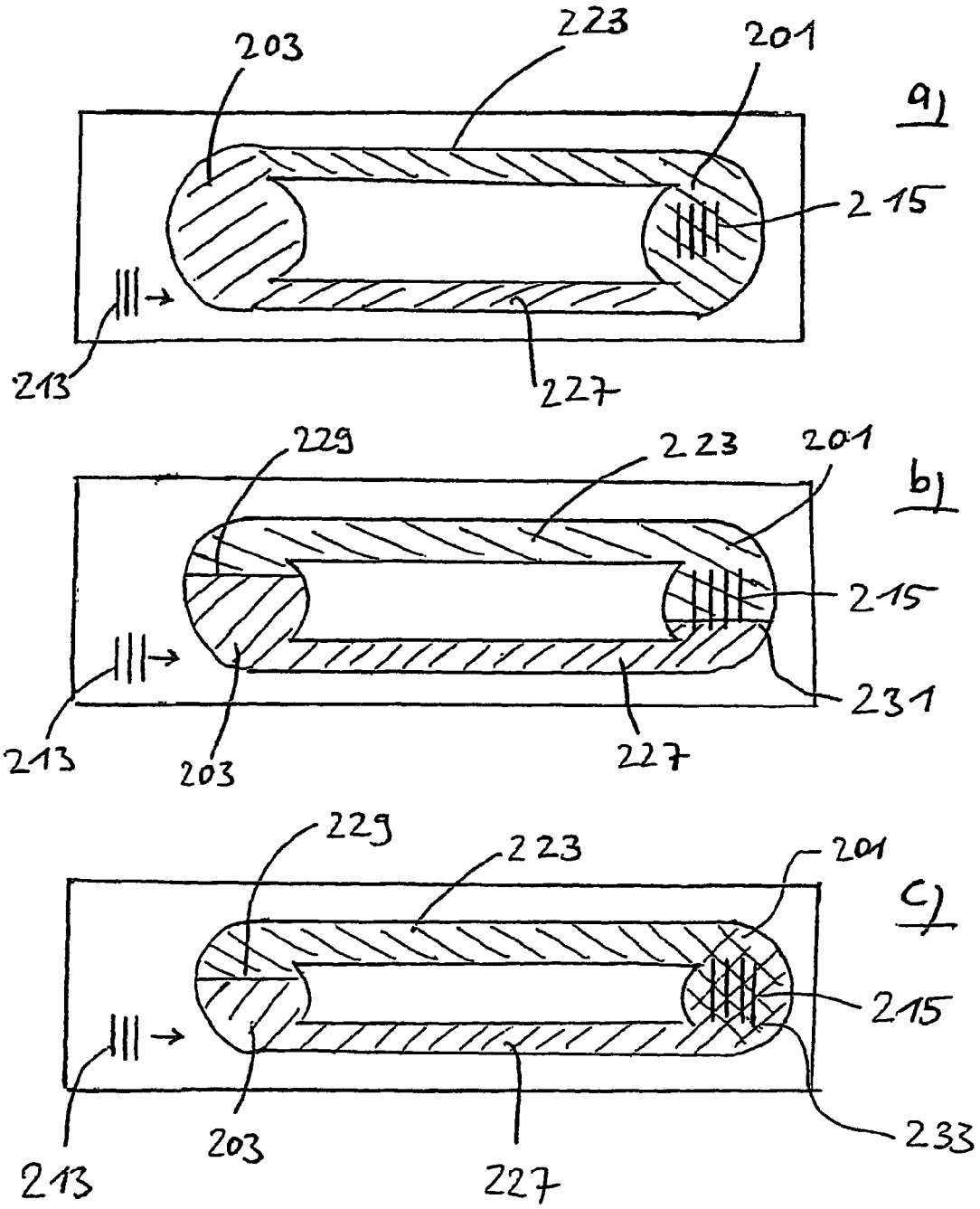
FIGS. 10*a*-10*c* horizontal cross-sections through an embodiment in accordance with the invention during three different method states.

FIG. 10 serves for the schematic representation of a different process management. Reservoirs 201 and 203 are connected to one another via two capillary structures 223, 227. An only schematically indicated interdigital transducer 213 has at least one radiation direction along the passage structure 227. A surface sound wave generation device 215, e.g. likewise an interdigital transducer, is located beneath the reservoir 201 and can radiate a sound wave into the liquid in the reservoir disposed above in a similar manner to the already describe surface sound wave generation structure 15.

A first liquid is introduced into the reservoir 203. The liquid enters into the capillaries 223, 227 due to the capillary force. A second liquid is introduced into the reservoir 201 for its complete filling. The operation of the interdigital transducer 213 generates a surface sound wave at least in the indicated direction. A laminar flow is generated in the passage 227 by the pulse transfer of the surface sound wave to the liquid in the passage.

The liquid from the passage 227 enters into the reservoir 201 and is resupplied from the reservoir 203. In this connection, the liquid boundaries 229, 231 move correspondingly. Since it is a case of a laminar flow and not a turbulent flow, no mixing takes place except for the diffusion at the liquid boundaries 229, 231. A state arises such as is shown in FIG. 10*b*.

The respective proportion of the liquids in the reservoir 201 can be determined by the selection of the time period and the pump power during which the interdigital transducer 213 is used for the generation of the surface sound wave. A surface sound wave is generated by the operation of the interdigital transducer 215 which results in the radiation of a sound wave into the liquid in the reservoir 201 and there effects corresponding flow patterns for the mixing of the two liquids. A mixing 233 arises as indicated in FIG. 10*c*.

The embodiment of FIG. 10 with a plurality of connection passage structures between the reservoirs can also be configured both as two-dimensional with corresponding wetting structures and as three-dimensional with corresponding wells or hollow spaces.

In all the embodiments described, total volumes of up to 1 ml with individual volumes of e.g. only 100 nl can be treated. The Figures are not to scale. The ratio of the volumes of the passage structures to the volume of the reservoirs thus amounts e.g. to between 1/10 to 1/100.

If a corresponding number of reservoirs and connection passage structures are provided, a plurality of liquids can be metered in and mixed simultaneously or successively.

The method in accordance with the invention and the device in accordance with the invention permit a precise metering of a quantity of liquid to a quantity of liquid defined by the volume of the second reservoir, for example by selecting the time in which a laminar flow is generated along the connection passage structure of the devices in accordance with the invention. The method is simple to carry out and the device can be configured as small, compact and, optionally, as a disposable part.

The embodiments in accordance with the invention can be operated in an automatic machine. Such an automatic machine has e.g. a receiver for a device in accordance with the invention which establishes electrical contact to the interdigital transducers. Pipetting heads and/or dispensers to be operated automatically are provided which are arranged such that they are arranged above the reservoirs or the filling structures when the device in placed in the receiver. Finally, a control, preferably having a microprocessor unit, is provided which serves for the time control of the pipetting heads/dispensers and of the interdigital transducers to work through a desired metering and mixing protocol. The evaluation instruments such as optical measuring devices, etc., can also be integrated in the automatic machines in order optionally to detect reaction triggered by the mixing process.

Reference numeral list

| | |
|---|---|
| 1 | reservoir, reaction chamber |
| 3 | reservoir |
| 5, 6 | connection capillary structure |
| 7, 11 | filling passages |
| 13, 14, 15 | acoustic chip |
| 17, 19 | filling stub |
| 101 | reservoir surface, reaction chamber |
| 103 | reservoir surface |
| 105 | areal connection passage structure |
| 121, 123 | liquid drop |
| 125 | liquid bridge |
| 127 | bridging drop |
| 201 | reservoir, reaction chamber |
| 203 | reservoir |
| 213, 215 | interdigital transducer |
| 223, 227 | connection passage structures |
| 229, 231 | liquid boundaries |
| 233 | liquid mixture |

The invention claimed is:

1. A device for the integrated metering and mixing of small quantities of liquid comprising a first reservoir for a first quantity of liquid;

a second reservoir for a second quantity of liquid;

filling passage structures which are in communication with a reservoir at one respective end and with a filling device at the other respective end;

at least two connection passage structures which connect the two reservoirs and have a cross-section at least in one region in the direction of view of the connection line of the reservoirs which is smaller than the cross-sections of the reservoirs;

at least one device for the generation of a laminar flow along at least one of said connection passage structures, the at least one device for the generation of laminar flow including a sound wave generation device having at least one radiation direction along at least a part of the at least one connection passage structure; and at least one device for the mixing of the quantities of liquid, the device for the mixing of the quantities of liquid being located in or on the second reservoir.

2. A device in accordance with claim 1, wherein the sound wave generation device is a surface sound wave generation device.

3. The device in accordance with claim 2, wherein the surface sound wave generation device is an interdigital transducer.

4. A device in accordance with claim 1, wherein the at least two connection passage structures have a narrow cross-section such that capillary forces are exerted onto at least one of the liquids by the side boundaries.

5. A device in accordance with claim 1, wherein the reservoirs and the connection passage structures are formed by wells in a surface.

6. A device in accordance with claim 1, wherein the reservoirs and the connection passage structures are formed by hollow spaces in a surface.

7. A device in accordance with claim 1, wherein the reservoirs and the connection passage structures are defined by regions on a surface which are more preferably wetted by the liquids than the surrounding surface.

8. A device in accordance with claim 1, having more than two reservoirs and a corresponding number of connection passage structures for the integrated metering and mixing of more than two quantities of liquid.

9. A device for the integrated metering and mixing of small quantities of liquid comprising, a first reservoir for a first quantity of liquid;

a second reservoir for a second quantity of liquid;

filling passage structures which are in communication with a reservoir at one respective end and with a filling device at the other respective end;

at least two connection passage structures which connect the two reservoirs and have a cross-section at least in one region in the direction of view of the connection line of the reservoirs which is smaller than the cross-sections of the reservoirs;

at least one device for the generation of a laminar flow along at least one of said connection passage structures; and at least one device for the mixing of the quantities of liquid, the device for the mixing of the quantities of liquid being located in or on the second reservoir, wherein the at least one device for the mixing includes a sound wave generation device for the generation of sound waves entering into the second reservoir.

10. A device in accordance with claim 9, wherein the sound wave generation device is a surface sound wave generation device.

11. The device in accordance with claim 10, wherein the surface sound wave generation device is an interdigital transducer.

* * * * *